United States Patent [19]

Markman et al.

[11] Patent Number: 4,625,632

[45] Date of Patent: Dec. 2, 1986

[54] DAMPER AND REGISTER BOX

[75] Inventors: Robert Markman, Pampano Beach, Fla.; Larry N. Markman, Longview, Tex.

[73] Assignee: Owl Flex, Inc., Kilgore, Tex.

[21] Appl. No.: 733,068

[22] Filed: May 13, 1985

[51] Int. Cl.[4] ..... F24F 13/00

[52] U.S. Cl. ..... 98/102; 98/114; 29/157.1 R

[58] Field of Search ..... 251/356, 305; 137/360; 29/157.1 R, 157 R; 98/101, 102, 114, 110, 103, 108

[56] References Cited

U.S. PATENT DOCUMENTS

| | | | |
|---|---|---|---|
| 363,181 | 5/1887 | Tallmage | 98/102 |
| 380,145 | 3/1888 | Springer | 98/114 |
| 633,455 | 9/1899 | Hood | 98/102 |
| 1,151,359 | 8/1915 | Hood | 98/102 |
| 2,102,681 | 12/1937 | Curtis | 98/114 |
| 2,939,377 | 6/1960 | Stach | 98/101 |
| 3,295,821 | 1/1967 | McQuown | 251/305 |
| 3,386,434 | 6/1968 | Castello et al. | 98/114 X |
| 3,606,404 | 9/1971 | McGann, Jr. | 98/114 X |
| 4,223,430 | 9/1980 | Sherlaw | 29/157.1 R |

*Primary Examiner*—Lloyd L. King

*Attorney, Agent, or Firm*—John M. Harrison

[57] ABSTRACT

A damper for register boxes which includes a round damper plate having tab connectors extending from opposite edges, with mount tabs provided on the extending ends of the tab connectors. The damper is designed to locate within the bore of an air duct which is fitted in a register box and the mount tabs are secured to the register box by duct fingers extending from one end of the air duct and folded across the mount tabs. The damper plate is adjustable in the air duct to any selected angle from a position substantially blocking the duct to a position substantially in longitudinal alignment with the duct, by mechanically deforming the tab connectors. A damper and register box apparatus which is characterized by a box frame having an air duct inserted therein. Metal fingers project from the air duct and a damper defined by a damper plate and projecting tab connectors and mount tabs, is fitted in the bore of the air duct and is secured therein by the metal fingers.

10 Claims, 5 Drawing Figures

FIG. 1
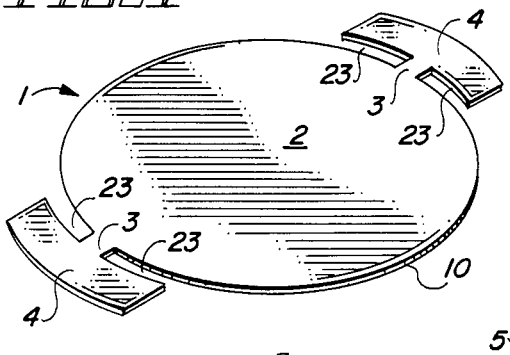
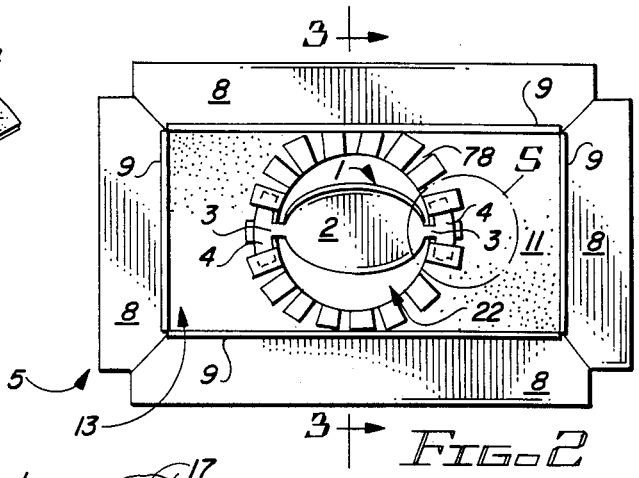
FIG. 2
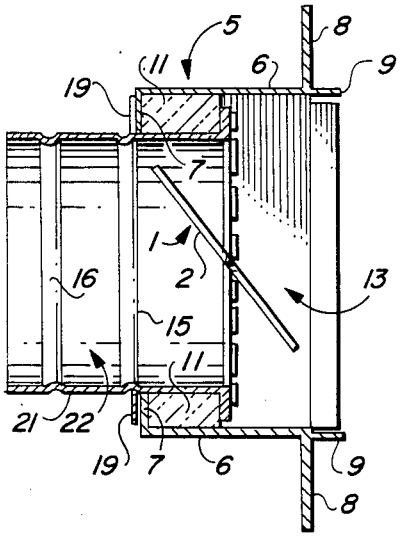
FIG. 3
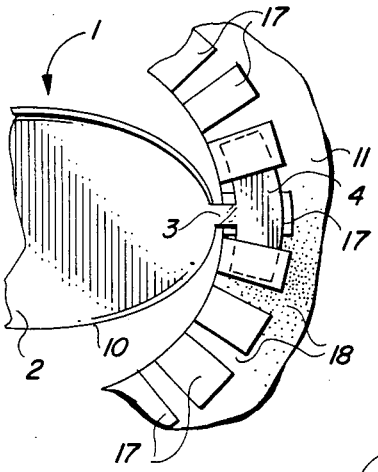
FIG. 4
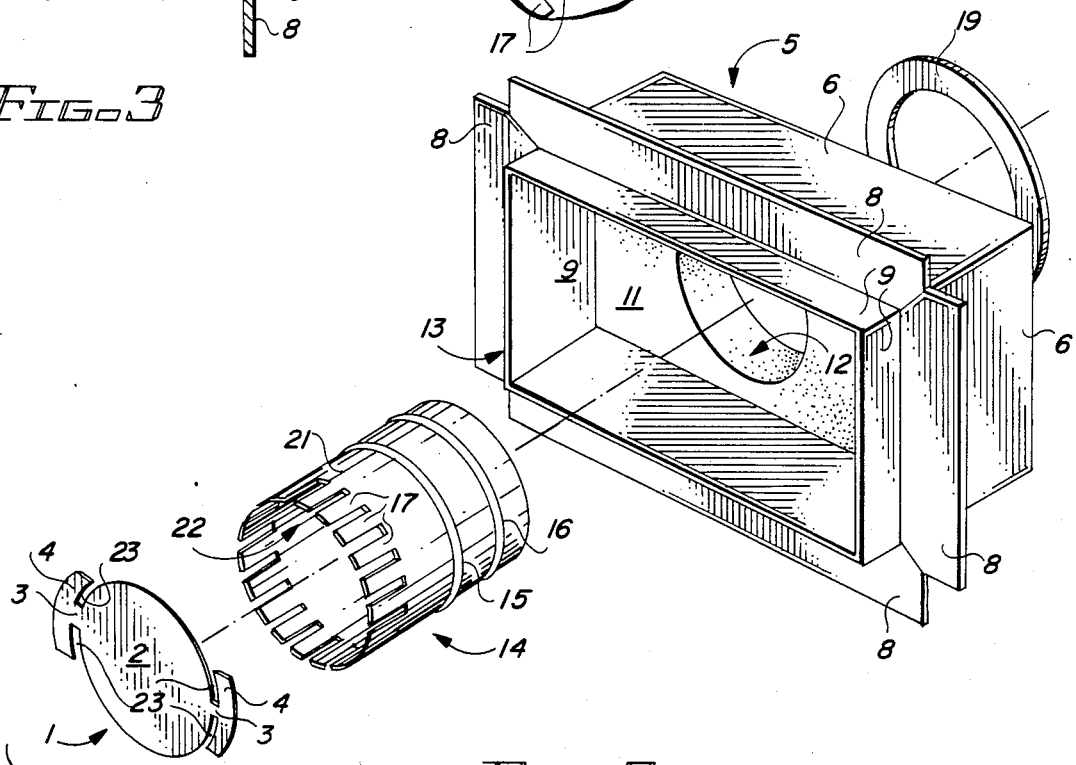
FIG. 5

DAMPER AND REGISTER BOX

BACKGROUND OF THE INVENTION

1. Field of the Invention

This invention relates to air transport systems for homes, office buildings and other structures and more particularly, to a specially designed damper and register box apparatus which can be used with substantially any air transport system to control the delivery of air in a structure. The damper of this invention can be used in any register box system and is characterized by a damper plate of appropriate shape which is fitted with a pair of oppositely-disposed mount tabs attached to the damper plate by means of fixed tab connectors. The damper plate is designed to mount in one end of an air duct located in the register box by engaging duct fingers provided on the air duct with the mount tabs extending from the damper plate. The damper plate is oriented in an air delivery opening which coincides with the bore of the air duct and the tab connectors are mechanically deformed to orient the damper in the air delivery opening at any desired angle, from a fully closed, to a fully open position. Since there is no linkage or adjusting mechanism associated with the damper or register box of this invention, the manually adjustable, air-regulating damper plate stays in a predetermined position to adjust the flow of air through the air delivery opening and register box in a positive manner. Furthermore, since the damper need not be adjusted frequently, no problem exists with regard to metal fatigue of the tab connectors which secure the damper in the air delivery opening of the air duct. Due to the absence of elaborate linkage and adjusting mechanisms in favor of a simple, manually adjusted damper system, the cost of the damper and associated register box is low, as compared to existing air balancing systems.

2. Description of the Prior Art

Many different techniques have been devised in the prior art to balance the air delivery systems in homes, offices, and other structures. An early patent pertinent to this art is U.S. Pat. No. 363,181, dated May 17, 1887, to H. K. Tallmage entitled "Combined Register, Border and Box". The Tallmage device includes a register which is characterized by a top and border plate having a central open portion and a sideway in combination with a box portion, a circular rim with a pivoted damper adapted to work in the rim and a pivoted connecting rod which is attached to the damper and is designed to adjust the damper to an open, closed or partially open position with respect to the rim. U.S. Pat. No. 380,145, dated Mar. 27, 1888, to Jay Springer, discloses a "Hot Air Register". The Springer device is characterized by a box-like structure having a perforated plate on the top thereof and including a toothed wheel rotatably secured inside the box. A linkage system is attached to a damper mounted in the throat of the hot air register, whereby rotation of the toothed wheel by manual adjustment causes the damper to open and close in the register throat. A similar device is disclosed in U.S. Pat. No. 405,620, dated June 18, 1889, to H. K. Tallmage, entitled "Hot Air Register". This air handling device includes a register box and a damper arranged in a lower portion of the register box, with a removable top plate positioned at the upper end of the register box. The damper and adjusting pin are located so as to permit removal of the top plate without the necessity of disconnecting the damper operating mechanism. A "Register" is disclosed in U.S. Pat. No. 633,455, dated Sept. 19, 1899 to C. S. Hood. The Hood register includes a fretwork surface plate, a register box provided with a sleeve to connect with a heater pipe, a butterfly valve or damper pivoted in the sleeve and an operating lever pivoted in the register box. One arm of the lever projects through a slot in the surface plate and the other end is fitted with a lateral bend, whereby the angled end is brought into operative engagement with a segment of the valve and is caused to travel in an arc transverse to the valve in several positions to adjust the damper. U.S. Pat. No. 1,151,359, dated Aug. 24, 1915, also to C. S. Hood, discloses a "Register" which is characterized by a register box formed of sheet metal and having an apertured bottom, with an angular collar located below the box and adapted for connection to a supply pipe. The collar is provided with an inwardly directed bead which receives the box bottom at the periphery of the aperture and serves to rigidly connect the collar to the box.

One of the problems realized in the use of conventional register box and damper combinations for adjusting the air flow to various points in a structure, is that of complexity. Typically, dampers are mounted in the throats of register boxes and air distribution ductwork with a pivoting function which is controlled by an elaborate adjusting mechanism in association with the dampers, to fully open, fully close, or partially open the dampers. Many of these connecting linkages and mechanisms are automatic in operation and are subject to frequent malfunction, depending upon the complexity of the automation used to control the damper. Some of the currently used mechanisms are manual in operation and in such cases, the damper is normally positioned in the ductwork or register box by means of a pin. However, use of a pin-mounted damper generally results in a "fluttering" of the damper in the air transport system, a condition which sometimes causes objectionable noise and reduces air handling efficiency. This problem is intensified under circumstances where the damper is substantially in the closed position, since air pressure in the ductwork or register box at the location of the damper is highest when the damper is this configuration. Other problems sometimes realized in conventional damper systems is the requirement of frequent lubrication of the linkage assemblies and systems, in order to insure acceptable operation. Lubrication is normally required, since ductwork and register boxes which utilize dampers are normally located in the attic or in a crawl space in the structure where dust and debris accumulate on all exposed controls and linkage systems.

Accordingly, it is object of this invention to provide a new and improved damper for register boxes, which damper is characterized by a damper plate fitted with oppositely-disposed mount tabs and deformable tab connectors, with the damper plate adjustable mounted in the register box throat by mechanical deformation of the tab connectors which attach the damper plate to the register box.

Another object of the invention is to provide a damper which is characterized by a round damper plate and a pair of mount tabs secured to opposite sides of the damper plate by means of fixed tab connectors, which are mechanically deformed to adjust the damper inside the register box in any angular position with respect to the mount tabs.

Still another object of this invention is to provide a new and improved damper for register boxes, which damper includes a damper plate having a configuration which is compatible with the air handling system associated with the register box chosen, which damper plate is fitted with oppositely-disposed mount tabs secured to the damper plate by metal tab connectors which are mechanically deformed to facilitate adjustment of the damper in substantially any angular location with respect to the mount tabs and the register box.

Still another object of this invention is to provide a damper for a register box, which damper includes a generally circular metal damper plate provided with oppositely-disposed, extending mount tabs and bendable tab connectors integrally formed with the damper plate, and the damper plate secured in the throat or air duct of a register box by means of fingers which engage the tab connectors, the damper adjusted with respect to the air duct by mechanically bending the tab connectors.

Yet another object of the invention is to provide a new and improved register box for air handling systems, which register box includes a box frame having an air supply duct extending therein with metal fingers projecting from the air supply duct. Further included is a damper characterized by a damper plate with oppositely-disposed metal tabs and tab connectors, the tabs engaged by the metal fingers of the air supply duct to mount the damper in the register box frame and facilitate adjustment of the damper by bending the tab connectors.

SUMMARY OF THE INVENTION

These and other objects of the invention are provided in a damper for mounting in register boxes and ductwork, and a damper and register box combination, which damper is characterized by a damper plate of appropriate shape having projecting mount tabs on opposite sides thereof, with mechanically deformable tab connectors connecting the mount tabs to the damper plate. The register box includes a box frame with an insulated rear wall and an air duct extending through the wall, with duct fingers extending into the register box from the air duct to engage the mount tabs and secure the damper in the air delivery opening of the air duct, the damper plate adjustable in the air delivery opening by mechanically bending the tab connectors.

BRIEF DESCRIPTION OF THE DRAWING

The invention will be better understood by reference to the accompanying drawing, wherein:

FIG. 1 is a perspective view of the damper of this invention;

FIG. 2 is a front elevation of the damper illustrated in FIG. 1, oriented in a register box;

FIG. 3 is sectional view, taken along line 3—3, of the damper and register box illustrated in FIG. 2;

FIG. 4 is an enlarged, sectional view of a preferred mount for the damper illustrated in FIGS. 1 and 2; and FIG. 5 is an exploded view of the damper and register box illustrated in FIGS. 1–4.

DESCRIPTION OF THE PREFERRED EMBODIMENTS

Referring initially to FIG. 1 of the drawing, in a preferred embodiment, the damper of this invention is generally illustrated by reference numeral 1. The damper 1 is characterized by a generally flat, round damper plate 2, having oppositely-disposed tab connectors 3 extending from opposite edges of the damper plate 2, and mount tabs 4 fitted on the extending ends of the tab connectors 3. Spaces 23 exist between those segments of the plate edge 10 which lie adjacent each tab connector 3 and each respective mount tab 4. While the damper plate 2 is illustrated in a round configuration, it will be appreciated that the damper plate 2 can be shaped into any desired configuration which accords with the shape of the air passage, ductwork, or register box in which the damper 1 is mounted, as hereinafter described. Furthermore, it will be appreciated that the damper plate 1, tab connectors 3 and the mount tabs 4 must be of sufficient thickness to withstand the air pressure in any such ductwork or register box. In addition, the tab connectors 3 must be capable of multiple mechanical deformation or bending, to locate the damper plate 2 in a desired angular position in the air passage. In a most preferred embodiment of the invention, the damper plate 2, tab connectors 3 and mount tabs 4 are stamped from a single sheet of metal such as tin, aluminum or like metal, for ease of fabrication and in order to best facilite angular adjustment of the damper plate 2 with respect to the mount tabs 4, as hereinafter described.

Referring now to FIGS. 1–5 of the drawing in a most preferred embodiment, the damper 1 is installed in a register box 5 for controlling the air flow in an air handling system. The register box 5 is further characterized by a box frame 6, having a rear wall 7, mount flanges 8 for attaching the register box 5 to the wall or ceiling of a structure and front flanges 9, which extend forwardly of the mount flanges 8. In a typical installation, the front flanges 9 are designed to receive a louvered air register or grille (not illustrated) which is designed to further control air flow from the register box 5. Insulation 11 is provided in the register box 5 against the rear wall 7 and a register box opening 12 extends through the rear wall 7 and the insulation 11 and communicates with the register box window 13, as is more particularly illustrated in FIG. 5. A tubular shaped air duct 14 is provided with duct fingers 17, defined by slots 18 on one end and is fitted with a forward rib 15, located rearwardly of the duct fingers 17 and a rear rib 16, spaced from the forward rib 15. When the air duct 14 is inserted through the register box opening 12 with the forward rib 15 adjacent the rear wall 7 of the register box 5, as illustrated in FIGS. 3 and 5, a ring 19 is fitted over the duct barrel 21 adjacent the rear wall 7 and serves to locate the air duct 14 securely in the register box opening 12. The ring 19 can be initially inserted over the duct barrel 21 rearwardly of the forward rib 15 and when the air duct 14 is fitted in the register box opening 12 as illustrated in FIG. 5, the ring 19 seats against the rear wall 7 and the duct fingers 17 project forwardly of the insulation 11, facing the register box window 13. The damper 1 is then positioned in associated with the duct fingers 17 by initially bending opposite ones of the duct fingers 17 against the insulation 11, inserting the tab connectors 3 in the resulting oppositely aligned spaces and pressing the mount tabs 4 against the bent duct fingers 17 and the adjacent insulation 11. The remaining duct fingers 17 are then bent outwardly against the insulation 11, with the duct fingers 17 which are located adjacent the tab connectors 3, bent over against the mount tabs 4, to secure the damper plate 2 in the bore 22 of the duct barrel 21, as illustrated in FIGS. 2–4 of the drawing. When the damper 1 is so installed in the register box 5, the damper plate 2 virtually blocks the bore 22 of the duct barrel 21 and substantially retards the flow of air from the air duct 14 into the register box 5 and through the register box window 13. However, as illustrated in FIGS. 2 and 3, the damper plate 2 can be positioned in any position between the fully open and fully closed orientation, by grasping the damper plate 2 and bending the tab connectors 3. When the damper plate 2 is adjusted to the desired angle in the bore 22 of the duct barrel 21, an appropriate volume of air is allowed to flow from the air duct 14 through the register box 5 and the register box window 13.

In operation, and referring again to the drawing, it will be appreciated that in the finished installation, the register box 5 will be provided with a louvered air register or grille (not illustrated) which is secured to the front flanges 9 of the box frame 6, as heretofore described. In a conventional installation, the louvered air register will be removably attached to the front flanges 9 by means of pins or screws, such that it can be easily removed to expose the register box window 13. Accordingly, when it is desired to adjust the flow of air through the air duct 14 and the register box 5, the louvered air register is first removed and the damper plate 2 adjusted in the bore 22 to the desired position, as heretofore described. Multiple adjustments can be made in the damper plate 2 without breaking the tab connectors 3. However, whenever the tab connectors 3 do break because of multiple mechanical adjustments of the damper plate 2, a new damper 1 is easily installed by simply straightening the duct fingers 17 which retain the mount tabs 4 against the insulation 11, removing the damaged damper 1 and substituting a new damper 1 by again bending the duct fingers 17 over the mount tabs 4 and against the insulation 11.

It will be appreciated by those skilled in the art that a primary feature of the damper and register box of this invention lies in simplicity of installation and easy replacement of the damper 1 when mechanical adjustment of the tab connectors 3 causes the tab connectors 3 to fail. There is no requirement of external levers, pivots, chains or automatic control mechanisms with attending mechanical difficulties for operation of the damper 1 of this invention. No lubrication is required and the damper 1 is characterized by positive air control pursuant to manual adjustment under any circumstance of air handling. The damper 1 is easily accessible, quickly adjusted and exchanged and results in a register box and damper combination which is inexpensive and easily maintained, whether mounted on the wall, ceiling or floor.

While a primary application for the damper of this invention is in register boxes such as the register box 5 illustrated in the drawing, it will be appreciated that the damper 1 can be installed in any ductwork or air handling system of any size or shape, depending upon the application desired. For example, the damper 1 can be installed in a round segment of ductwork in the manner taught by this invention under circumstances where access is provided to the damper 1, either by uncoupling the ductwork or through a port or other access opening provided near the damper 1. Other applications will become apparent to those skilled in the art from the teaching of this invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is;

1. In an air handling system having a conduit and a register box terminating the conduit for directing air flow, the improvement comprising a damper plate and a first tab connector projecting outwardly from a first segment of said damper plate, said first segment located on the periphery of said damper plate; a second tab connector projecting outwardly from a second segment of said damper plate, said second segment located on the periphery of said damper plate and substantially 180° disposed from said first segment and said first tab connector; a first mount tab terminating said first tab connector; and a second mount tab terminating said second tab connector said first mount tab and said second mount tab adapted for attachment to the register box, whereby said damper plate is adjustable in the conduit by bending said first tab connector and said second tab connector.

2. The damper of claim 1 wherein said damper plate is constructed of metal and said first tab connector, said first mount tab, said second tab connector and said second mount tab are all shaped integrally with said damper plate.

3. The damper of claim 2 wherein said damper plate is substantially round.

4. In a register box having an air distribution opening, the improvement comprising a damper characterized by a damper plate shaped to substantially conform to the shape of the air distribution opening; a first tab connector and a first mount tab terminating said first tab connector projecting outwardly from the periphery of said damper plate in fixed relationship for attachment to the register box on one side of the air distribution opening; and a second tab connector and a second mount tab terminating said second tab connector projecting outwardly from the periphery of said damper plate and oppositely-disposed, fixed relationship with respect to said first tab connector and said first mount tab for attachment to the register box on the opposite side of the air distribution opening, whereby said damper plate is adjustable in the air distribution opening responsive to mechanical bending of said first tab connector and said second tab connector.

5. The damper of claim 4 wherein said first tab connector said first mount tab, said second tab connector and said second mount tab are shaped integrally with said damper plate.

6. The damper of claim 5 wherein said damper plate, said first tab connector, said first mount tab, said second tab connector and said second mount tab are metal.

7. In a register box designed to distribute air into a room of a structure, the register box having a box frame and an air duct extending into the box frame, improvement in combination therewith comprising a damper plate adapted for positioning in the air duct and a bendible first tab connector terminated by a first mount tab and a second tab connector terminated by a second mount tab, said second tab connector and said second mount tab extending in substantially 180° opposed relationship with respect to said first tab connector and said first mount tab in fixed relationship, said first tab connector and said first mount tab and said second tab connector and said second mount tab adapted for mounting in the box frame on opposite sides of the air duct, whereby said damper plate is adjustable in the air duct by mechanically bending said first tab connector and said second tab connector.

8. The register box of claim 7 wherein said air duct and said damper plate are substantially round.

9. The register box of claim 8 wherein said first tab connector, said first mount tab, said second tab connector and said second mount tab are formed integrally with said damper plate.

10. The register box of claim 9 wherein said damper plate, said first tab connector, said first mount tab, said second tab connector and said second mount tab are metal.

* * * * *